United States Patent [19]

Mills

[11] Patent Number: 4,873,635

[45] Date of Patent: Oct. 10, 1989

[54] PUMP-OFF CONTROL

[76] Inventor: Manual D. Mills, P.O. Drawer 1073, Midland, Tex. 79702

[21] Appl. No.: 932,846

[22] Filed: Nov. 20, 1986

[51] Int. Cl.[4] ..... F04B 49/00

[52] U.S. Cl. ..... 364/422; 73/151; 417/12

[58] Field of Search ..... 364/422; 93/151, 151.5; 417/12, 22, 18

[56] References Cited

U.S. PATENT DOCUMENTS

| | | | |
|---|---|---|---|
| 3,817,094 | 6/1974 | Montgomery et al. | 73/151 |
| 3,838,597 | 10/1974 | Montgomery | 73/151 |
| 3,851,995 | 12/1974 | Mills | 417/12 |
| 3,930,752 | 1/1976 | Douglas | 417/53 |
| 3,936,231 | 2/1976 | Douglas | 417/12 |
| 3,951,209 | 4/1976 | Gibbs | 166/250 |
| 4,363,605 | 12/1982 | Mills | 417/44 |
| 4,487,061 | 12/1984 | McTamaney | 417/12 |
| 4,490,094 | 12/1984 | Gibbs | 417/53 |
| 4,631,954 | 12/1986 | Mills | 417/12 |

*Primary Examiner*—Jerry Smith
*Assistant Examiner*—Kim Thanh Tbui
*Attorney, Agent, or Firm*—Marcus L. Bates

[57] ABSTRACT

A pump-off controll device for controlling a pumpjack unit. The device measures the length of time required for the pump to downstroke successive numbers of times, and when the time differential reaches a predetermined value, the well is shut-in for a time interval.

20 Claims, 17 Drawing Sheets

PUMP-OFF CONTROL

BACKGROUND OF THE INVENTION

Electro mechanical apparatus for monitoring the operation of sucker rod type well pumping units is known to those skilled in the art as evidenced by my previous Pat. Nos. 3,851,995; 4,363, 605; 4,043,191; and 4,208,665. In my Pat. No. 4,363,605, a pumpjack unit has a rod string which is weighed continuously during the pumping action and the resultant data utilized to shut-in the well when a predetermined reduction in weight is sensed. Also note Gibbs Pat. No. 3,951,209 for similar art.

Montgomery Pat. No. 3,817,094 weighs the deflection of the walking beam of a pumpjack unit for providing a signal used for controlling the motor of a pumpjack unit.

In my co-pending patent application Ser. No. 634,544 filed July 25, 1984, relative movement between coacting components of a pumpjack unit is utilized as a control signal for shutting in a well.

Montgomery Pat. No. 3,838,597 measures the load during the pumping action and produces a signal which shuts-in the well upon encountering a pump-off condition.

Gibbs Pat. No. 4,490,094 measures the instantaneous motor speeds of revolutions for a pumpjack unit, and compares the results with the instantaneous speeds of revolutions of a pump-off condition in order to shut-in a pumpjack unit.

The present invention provides a pump-off control that indirectly measures the efficiency of the pumping action by counting the length of time required for the pumpjack unit to make one complete cycle of operation, or at least a portion of the downstroke; and, when the measured time interval changes a predetermined amount, the well is shut-in for a predetermined length of time. The portion of the measured pumping cycle must include that part of the downstroke where fluid pounding historically occurs.

A pumpjack unit utilizing a string of sucker rods for actuating a downhole pump requires a finite amount of work in order to lift a full barrel of liquid to the surface of the ground each pumping cycle. Most pumpjack units utilize a high slip electric motor which is designed to operate under varying load conditions. All electrical motors slip; that is, the rpm will decrease as the load increases. Pumpjack units utilizing electrical motors have special designed high slip motors which can tolerate the variable load occasioned by the varying power requirement as the pumpjack unit upstrokes and then downstrokes. In other words, the motor is designed to slip a large amount as the load is increased.

The load on the sucker rod can be measured during each pumping cycle, and the resultant data used to plot a graph of the instantaneous load versus the pump plunger position. This plot of data is called a "dynamometer card". The curve of a dynamometer card is drawn by attaching weight measuring and rod position indicator apparatus to the polish rod or bridle of a pumpjack unit, such as discussed in several of my previously mentioned patents for example.

The area defined by the dynamometer curve can be related to horsepower requirement. The horsepower requirement between a full barrel pumping condition, and a partially full barrel pumping condition is considerable. This change in power requirement is reflected in the load required by the high slip motor, which varies considerably between these two extremes. Accordingly, as the pumping action proceeds from a full barrel to a pump-off condition, the time differential required for the pump to downstroke is considerable and this change in the time interval can be utilized as a control signal for detecting a pump-off condition and thereby provide a control for the pumpjack unit.

The time differential always occurs on the downstroke because the hydrostatic head of the column of fluid being supported by the rod string is theoretically removed form the pump plunger during the downstroke, and it is during that interval of time that fluid pounding occurs. Therefore, it is the downstroke of the pumping cycle that varies in time, whereas the upstroke is of a relatively constant time interval.

A comprehension of the above observations is necessary in order to fully appreciate this invention. This novel and unexpected method of generating a signal related to a pump-off condition brings about other patentable concepts. Applicant has observed that the time interval for a full stroke to be carried out on pumpjack unit never exceeds a maximum value of predetermined magnitude unless a particular malfunction has occurred to the pumping system. This novel concept enables a computer controlled system to provide remedial action for a number of possible well malfunctions in addition to detection and shut-in for fluid pounding.

SUMMARY OF THE INVENTION

This invention comprehends method and apparatus for controlling a well pump, and more particularly a control apparatus by which the operation of a pumpjack unit is monitored and continuously automatically controlled. The invention shuts-in a pumpjack unit for a selected length of time whenever the downhole pump apparatus associated therewith encounters a pump-off condition of operation This unique control is achieved by measuring the time interval required for the pump plunger to downstroke with a full barrel, then measuring the time interval required for the pump plunger to downstroke with less than a full barrel, the latter being the beginning of a pump-off condition. A determination is made in the difference in the time for the full barrel stroke and the fluid pounding stroke, and this time differential is used as a control device for shutting-in the well. The well is shut-in when the differential reaches a predetermined magnitude which is considered to be representative of undesirable fluid pounding.

Circuit means, including a transducer and a computer, is included in the apparatus. The computer is programmed to receive information from the transducer. The transducer provides a signal for measuring downstroke time differential. This information is used for operating the prime mover controller such that the well is shut-in for a predetermined time in response to change in the time differential. The shut-in time is predicated on the history of the well. Then the well is restarted and the pumpjack unit continues to pump until fluid pounding is again incurred.

An H2S sensor is connected to the circuitry and provides a signal to the computer so that a warning signal is turned on by the computer when sour gas is detected.

A start alarm is also included in the circuitry. The alarm is activated for a time interval prior to starting the pumpjack unit each time the well is shut-in.

The computer measures the time intervals of succeeding cycles, or strokes, and compares the time interval of a full barrel stroke with the time interval of a fluid pound stroke. The 360°measured time interval of each cycle of operation provides a signal which always falls within an anticipated time frame, unless there is a malfunction such as sensor failure, rod part, short run malfunction, or excessive long run malfunction all of which can be detected and the appropriate logical steps taken for remedial action.

Therefore, a primary object of the present invention is the provision of a pump-off control method and apparatus which uses the time differential required for the downhole pump to downstroke with a full barrel, as compared to a partially full barrel which is indicative of fluid pounding, with the resultant time differential being used by a computer to shut the well in for a predetermined period of time, and thereafter restart well production until another fluid pounding condition is encountered.

Another object of this invention is the provision of a method which requires measuring the length of time for a downstroke and utilizing the difference in the measured time as well as control signal which is also an indication of fluid pounding.

A still further object of this invention is to measure each 360°of cyclic operation of the pumpjack unit to provide a signal which is treated to ascertain sensor failure, rod part, short or long run malfunctions; all of which is detected and the appropriate logical steps taken for remedial action.

An additional object of this invention is the provision of the cyclic operation of a pumpjack unit is timed each 360°of rod reciprocation to provide a time differential between succeeding cycles, which is analyzed to determine well malfunction, whereupon remedial action is taken to protect the pumpjack and well.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described herein.

DETAILED DESCRIPTION OF THE PREFERRED EMBODIMENT

Figure 1:
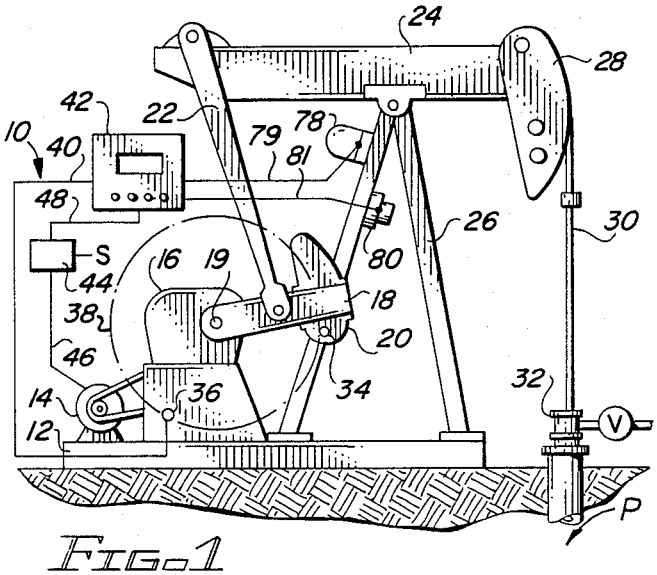
FIG. 1 is a part diagrammatical, part schematical, part cross-sectional, side elevational view of a pumpjack unit having a pump-off control associated therewith made in accordance with the present invention.

In FIG. 1, there is disclosed a prior art pumpjack unit in combination with a pump-off control apparatus 10 made in accordance with the present invention. The pumpjack unit includes the usual base 12, high slip three phase motor 14, and a gear box 16 which rotates crank 18 in the indicated circle 38 about center 19. Counterweight 20 is fastened to the rotating free end of the crank 18. Pitman 22 connects the crank 18 to a walking beam 24. The walking beam is journaled to the upper end of the Sampson post 26. Horsehead 28 receives the illustrated bridle thereon for reciprocating the usual polish rod 30. Stuffing box 32 sealingly receives the polish rod and forms the upper terminal end of the wellbore. A downhole pump "P" is located downhole in the illustrated borehole in the usual manner.

The high slip motor 14 drives the reduction gear box 16 which rotates the shaft 19 and thereby oscillates the horsehead 28, which in turn reciprocates the polish rod 30. The polish rod is connected to a rod string (not shown) which reciprocates the plunger of a pump P located downhole in the wellbore. Production occurs through the indicated valve V.

A traveling magnet located at position 34 is attached to the side of the counterweight which is closes adjacent to the gear box. A transducer is mounted as shown by the numeral 36. The transducer 36 is responsive to the lines of magnetic flux effected by magnet 34 as the magnet travels to describe circle 38.

Electrical conductor 40 connects the transducer 36 to a pump-off control circuitry 42 made in accordance with the present invention. A motor controller 44 of prior art design connects a source S of electrical current to the motor 14 by means of the illustrated conductors 46. Conductors 48 connect the pump-off control circuitry 42 to the motor controller 44.

Figure 2:
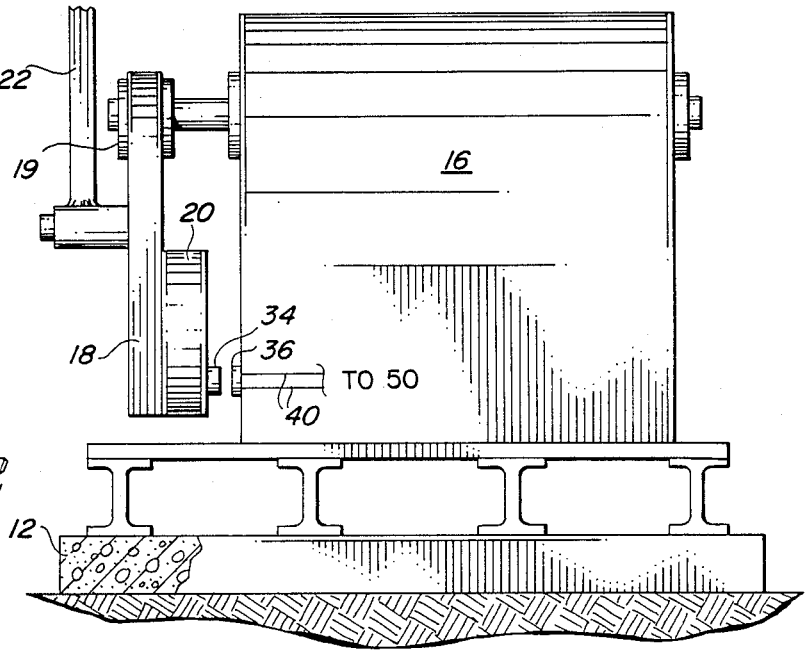
FIG. 2 is an end view of part of the apparatus disclosed in FIG. 1.

FIG. 2 of the drawings illustrates one manner in which the magnet 34 can be attached to the cyclically moving parts of the pumpjack apparatus. In FIG. 2, the traveling magnet 34 is attached by any suitable means to the counterweight 20, while the transducer 36 is attached in fixed relationship respective to the gear box 16, and in close proximity to the rotating magnet, so that a signal is generated within the conductor 40 each 360°of rotation of the counterweight 20.

Figure 3:
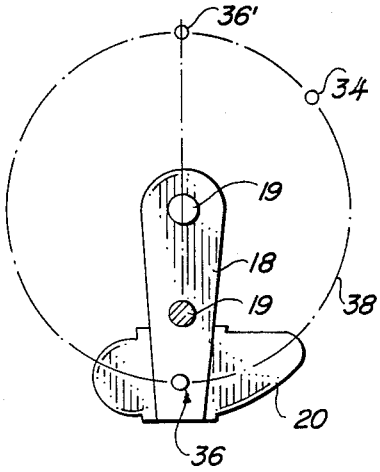
FIG. 3 is a diagrammatical, part cross-sectional representation of part of the apparatus disclosed in FIGS. 1 and 2.

In FIG. 3, numeral 36 and 36′ indicate that one or a plurality of transducers can be arranged along the circle 38 described by the rotating magnet 34 so that the rotating magnet 34 will sequentially cut the transducers with lines of magnetic flux, thereby providing two signals each 360°of rotation.

Figure 4:
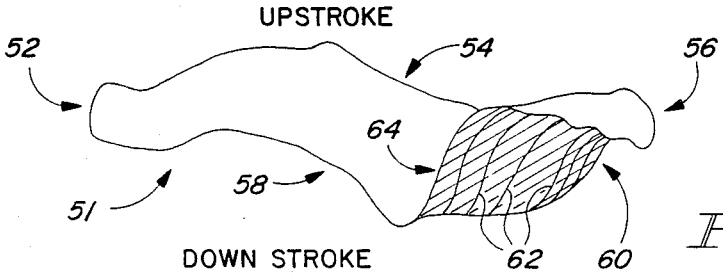
FIG. 4 is a plot showing the operational characteristics of an operating pumpjack unit.

FIG. 4 shows a dynamometer curve, usually referred to as a dynamometer card. The curve can take on any number of different forms. The dynamometer card of FIG. 4 is typical of data that can be plotted when the tension in the polish rod 30 is measured and plotted against the position of the reciprocating polish rod, as the rod strokes up and down within the wellbore. Data, such as suggested in FIG. 4, can be mechanically drawn by employing apparatus in accordance with my previous Pat. Nos. 4,208,665 and 4,363,605 to which reference is made for further background of this invention.

In FIG. 4, numeral 52 of the plot represents the end of the downstroke of the pumpjack unit of FIG. 1; the upstroke 54 terminates at numeral 56, which also is the start of the downstroke; while part of the downstroke 58 can take on any number of different forms at 60, 62, and 64 depending upon the downhole pumping condition of the wellbore being produced by the pumpjack unit. There are those who have devoted a lifetime of study to the curve such as seen in FIG. 4.

Figure 5:
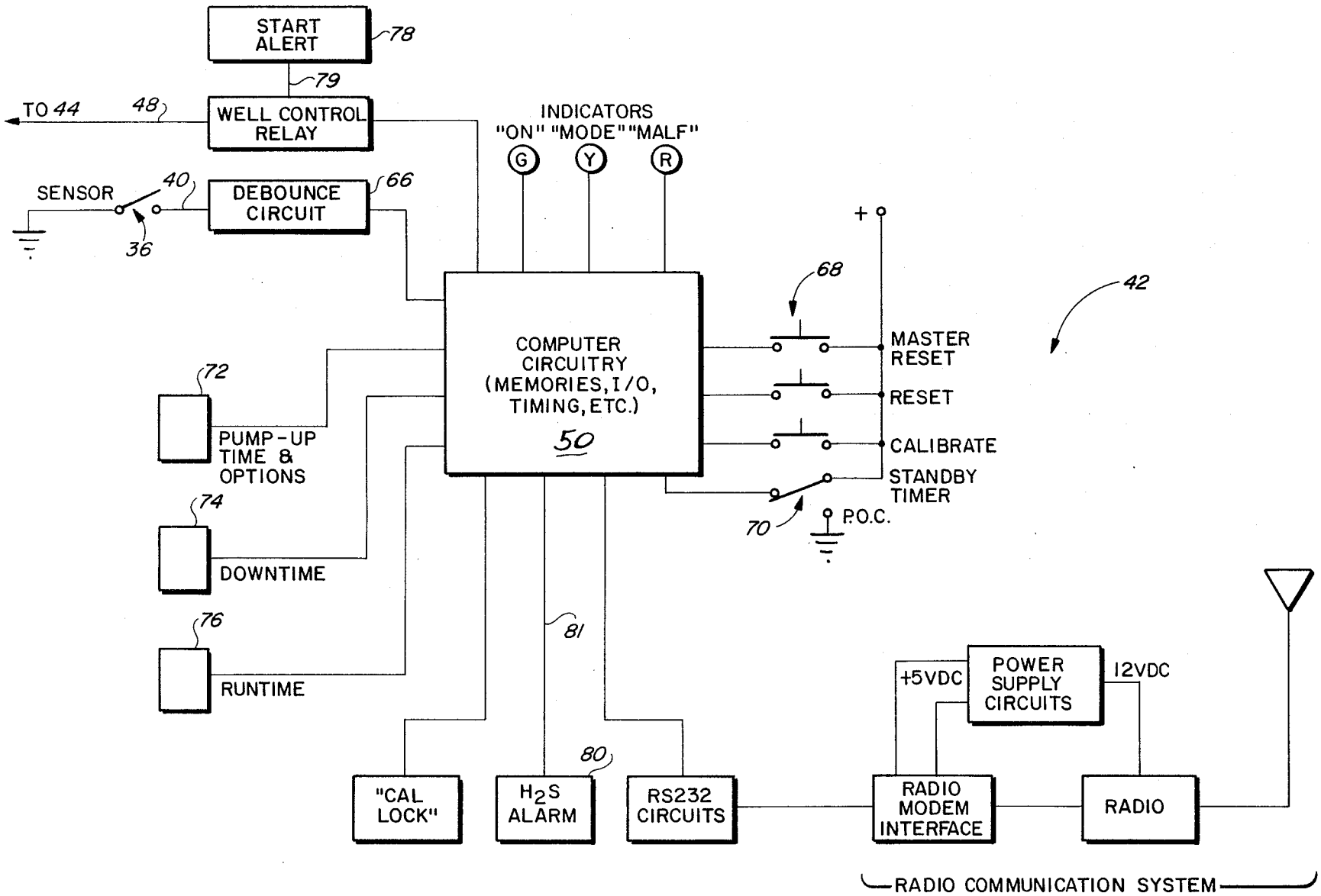
FIG. 5 is a schematical representation of circuitry used in conjunction with the apparatus of FIG. 1.

In FIG. 5, the circuitry 42 includes a computer 50. Transducer 36 is represented in FIG. 5 by the switch illustrated at 36. The switch 36 is connected by conductor 40 to "debounce circuitry" 66, which provides the computer 50 with a clean signal. The debounce circuitry 66 is known to those skilled in the art. Numeral 68 broadly indicates a plurality of switches which include a master reset switch, a reset switch, and a calibrate switch. Numeral 70 indicates a manually operative switch for changing the control circuitry from a pump-off control mode into a standby timer mode.

Numeral 72, 74, and 76, respectively, are "dip switches" for adjusting the pump-up time, down time, and run time, respectively.

A start alert 78 is connected at 79 to the well control relay. An H2S sensor and alarm 80 is connected at 81 to provide computer 50 with a signal indicating that sour gas is escaping from the wellhead.

tion as the condition progressively worsens from a full barrel at 60, to progressively less than a full barrel at 62 where the more severe pump-off condition is encountered at 64. It is desirable to stop the operation of the well at some acceptable value of fluid pounding at 62 prior to encountering the severe pump-off condition at 64.

The progressive pump-off condition illustrated in the following chart can be related to the curve of FIG. 4. The chart shows 14 different producing wells, and the strokes per minute (SPM); stroke length (SL); full barrel stroke time; average strokes per minute, fluid pounding stroke time; average strokes per minute, and the time differential between the fourth and sixth columns (average per minute). The time difference ΔT is accurate, reproducible, and can be measured as set forth herein.

| SMP | SL | FULL BARREL STROKE TIME | AVERAGE PER MIN | FLUID POUND STROKE TIME SECONDS | AVERAGE PER MIN | DIFFERENCE PER MIN ΔT | PUMP DEPTH |
|---|---|---|---|---|---|---|---|
| 10.5 | 88" | 5.76 | 60.48 | 5.70 | 59.85 | .63 | 5200 |
| 11.5 | 64" | 5.39 | 61.99 | 5.32 | 61.18 | .81 | 5200 |
| 7.75 | 80" | 7.79 | 60.30 | 7.77 | 60.30 | .04 | 9200 |
| 8.6 | 168" | 7.09 | 60.97 | 7.02 | 60.37 | .60 | 5900 |
| 7.7 | 100" | 7.78 | 59.91 | 7.75 | 59.67 | .24 | 2900 |
| 9.6 | 100" | 6.28 | 60.29 | 6.25 | 60.00 | .29 | 2900 |
| 15.0 | 54" | 3.77 | 56.55 | 3.75 | 56.25 | .30 | 4300 |
| 10.0 | 86" | 6.40 | 64.0 | 6.34 | 63.40 | .60 | 4200 |
| 10.7 | 120" | 5.79 | 61.95 | 5.70 | 60.99 | .96 | 8000 |
| 7.0 | 168" | 9.04 | 63.28 | 9.00 | 63.00 | .28 | 9300 |
| 5.5 | 100" | 10.89 | 59.89 | 10.84 | 59.62 | .27 | 2400 |
| 6.7 | 24" | 8.98 | 60.17 | 8.96 | 60.03 | .14 | 2400 |
| 3.6 | 31" | 16.79 | 60.44 | 16.75 | 60.16 | .28 | 2400 |
| 10.2 | 31" | 5.89 | 60.07 | 5.86 | 59.77 | .30 | 2400 |

OPERATION

Accordingly, the method of the present invention provides a pumpjack unit, such as illustrated in FIG. 1, which includes the usual polish rod 30 extending downhole into a wellbore 32 where it reciprocates a downhole pump apparatus P having the usual pump plunger and barrel. The polish rod is reciprocated by the walking beam 24 which is rocked by the crank assembly 18 attached to gear box 16. A three phase high slip motor 14 drives the gear box.

Motor 14 is connected to a suitable source of current by means of the control box 44. Control 44 is operated by circuitry 42, which includes a computer programmed to achieve the functions recited herein. The computer receives a signal from transducer 36 indicating the start at 56 of the downstroke 58 (FIG. 4). The controller also receives a signal from sour gas detector and alarm 80 so that an alarm is sounded whenever sour gas escapes from the wellhead 32.

The controller 42 energizes the start alert or visual alarm device 78 for ten seconds prior to energizing motor controller 44, so that workmen in proximity of the moving parts of the pumpjack have ample time to get out of the way, or to manually interrupt the energization of motor 14.

A pump-off condition of operation causes fluid pounding, and results from the pump barrel being only partially filled during the upstroke so that unacceptable jarring results on the downstroke. As seen in FIG. 4, the power expended on the upstroke of a pumpjack is constant while the power expended on the downstroke changes with respect to the amount of fluid contained within the pump barrel. As the well becomes pumped-off, the dynamometer card reflects the pump-off condi- As seen in the above chart, the time required for the pump to downstroke with a full barrel is significantly greater than the time required to downstroke the pump with less than a full barrel. Hence, the length of time for one cycle of operation or 360° of rotation of the counterweight 20, progressively decreases as the pump-off condition worsens. A severe pump-off condition compared to a full barrel condition, an amount to $\Delta T = 0.04$ to 0.96 minutes as noted in the above chart. Accordingly, the length of time required to downstroke a pump with a full barrel compared to the length of time required to downstroke a pump plunger that has encountered a pump-off condition is considerable. This time differential is of sufficient magnitude to enable it to be utilized to determine that a particular well has encountered a pump-off condition; and, should therefore be shut-in for a length of time required to enable the downhole production zone to recuperate, and before severe fluid pounding is encountered. That is, the well needs to be dormant for a length of time required for the casing annulus to be refilled with formation fluid before restarting the pumpjack unit. This information is available from the production history of any well, and is easily obtained by those skilled in the art.

The downstroke is timed by the provision of a signal which is generated by the cyclic pumping motion of the pumpjack unit. It is preferred to utilize the crank 18 for indexing the position of the downhole pump plunger, and positioning a magnet somewhere on the crank, or on the counterweight associated with the crank, respective to a transducer 36 so that the magnet 34 passes in close proximity of the transducer 36 and triggers the transducer at the start 56 of the downstroke 58, as seen in FIG. 4, for example.

The transducer can take on any number of different forms, but preferably is a magnetically actuated switch. Other signal producing apparatus can be utilized as may be deemed desirable.

As illustrated in FIG. 3, it is possible to use two transducers located at 36 and 36' and positioned 180°apart to define the beginning and end 56 and 52 of the downstroke. The transducers can be positioned other than 180°apart, as may be desired, so that less than the entire downstroke is observed by the computer. It is preferred, however, to use a single magnet and transducer so that the computer senses only the start 56 of the downstroke. The computer measures the time interval between signals, in this instance, and can be made to look at any desired part of the curve, as may be desired.

A well crank arm 18 rotates at about 10 rpm and accordingly, each revolution of the crank requires approximately six seconds. As pointed out above, this measured time will vary several thousandths of a second depending upon rod tension during the downstroke, or the area of the curve of FIG. 4, which caries the load on the high slip motor and causes the high slip motor to significantly change speed as the well progresses from a "full" barrel to a "pump-off" barrel.

The term "pump-off condition" as used herein is intended to comprehend the condition or pumping characteristics of a downhole pump P reciprocated by a sucker rod string, wherein the formation fluid level has been lowered by the pumping action until the pump barrel is only partially full each downstroke of the pump, thereby causing the downhole pump P to progressively proceed towards and eventually encounter a fluid pounding condition. Fluid pounding is a severe pump-off condition which should be avoided because the pounding subjects the downhole pump, sucker rod string, and the entire pumpjack apparatus to undesirable stress and strain.

Accordingly, as the pump-off condition is aggravated, it is necessary to shut-in the well for awhile, and then resume production. This is achieved by measuring the time intervals for the plunger to downstroke with a full barrel which is less than maximum pump speed, as shown in the above chart. Eventually the pump commences to pump-off, and the time interval for the plunger to downstroke when the pump barrel is less than full decreases until it reaches a value such as indicated in the above chart. This measurement provides a finite time differential having a predetermined magnitude and is used as the signal for the computer which sends a signal at 48 causing motor controller 44 to de-energize the motor 14. Next, the computer enters a down-time cycle which can be preset at 74 in FIG. 5. The down-time cycle enables the downhole reservoir to be replenished with formation fluid. Next, the computer energizes the well control relay which first sounds the start alert 78 for ten seconds and the energizes the motor controller at 44.

Switch 70 enables the pump-off control (POC) to be utilized; or, when switch 70 is in the illustrated position of FIG. 5, the sensor 36 is circumvented and the computer starts and stops the well control relay in accordance with the setting of the down-time 74 and run-time 76. Run-time 76 therefore is a timer means included within the computer circuitry that determines the length of time that the motor is energized prior to being de-energized. The run-time and the down-time are both determined by studying the well history or by studying the operation of the well prior to selecting the variables and instructing the computer.

The computer 50 can be of any number of different manufactures so long as it has ample facilities for storage and information retrieval. The timers 72, 74, and 76 are control devices which can be manually set and are connected to the computer 50 by using well known techniques.

The RS232 circuits enable a transmitter-receiver to be utilized for communicating with the computer 50. The radio communication system is an optional detail of design.

EXAMPLE I

As the pumpjack reciprocates the polish rod, a signal is generated in transducer 36 by the rotating magnet 34. As seen in the above chart, a pumpjack unit making 8.6 strokes per minute, for example, requires 7.09 seconds for a full barrel stroke; and, only 7.02 seconds for a fluid pound, or less than full barrel stroke. Accordingly, the length of time for the magnet to complete 360°varies 0.07 seconds when running under full load as compared to the smaller load realized at fluid pounding.

This time differential is used to de-energize the motor 14 and start the down-time. On the other hand, should the traveling magnets speed up to a time of 6.02 seconds, a drastic malfunction must have occurred to cause the motor 14 to run under no load condition. Such a change in stroke speed is an indication of rod part somewhere downhole in the borehole. Therefore, the computer 50 is programmed to shut-in the well whenever the measured stroke time is reduced to a value indicative of no load condition.

When the computer 50 senses this drastic reduction in time, which is representative of a no load motor condition, the well control relay causes the motor controller 44 to be locked into the de-energized configuration so that the pumper will subsequently be alerted to investigate the cause for the lockout. He can do this by either calling the field engineer, or by manually overriding the lockout by moving the switch 70 into the illustrated position of FIG. 5, whereupon the pumpjack unit will commence cyclic operation and it will soon be obvious to the pumper that the pumpjack unit is operating under no load condition.

EXAMPLE II

The computer makes a time measurement for every stroke by receiving the signal from the signal generating means or sensor 36. Should there be a sensor failure, for example in the magnetic reed switch or circuitry therefor, such a malfunction would result in a longer time interval being sensed by the computer. This would be at least double any time interval acceptable to the computer, and since the computer keeps track of the fastest and slowest stroke speed, should it ever receive a signal which is twice the expected stroke speed, the computer is programmed to (90 into % timer).

The computer flags a "sensor failure" and takes the appropriate action to take control of the well by going into the % time mode, in a manner similar to moving switch 70 from the pump-off control (POC) into the illustrated position of FIG. 5. Therefore, the computer is able to control the well by running the motor a desirable length of time and thereafter going into the predetermined down-time. Hence, the computer does not need the reed switch 36 in order to run in the percent standby mode.

EXAMPLE III

The computer is timing everything internally, as noted above, and it is instructed that if the well ever runs twice as long as it should, it will assume that it has failed to detect a fluid pounding condition and must have failed to control properly. In this instance, it will recover from a possible malfunction by taking the appropriate remedial action. The computer does this by going into the standard down-time to enable the reservoir to recover, then starts over again. Accordingly, the computer can make an intelligent recovery from an equipment malfunction of almost any imaginable nature.

The computer has been programmed as noted and therefore is imparted with intelligence, and since it monitors all of the different times, it can provide a pump-off control apparatus that shuts-in the well at any predetermined degree or magnitude of fluid pounding, as well as providing sensor failure detection, short runtime malfunction, excessive long-time malfunction, and parted rod malfunction. The apparatus and method of the present invention takes the logical recovery action whenever any of these undesirable conditions are encountered.

As noted in FIG. 5, one can communicate bidirectionally with the computer using known techniques such as phone lines, radio, and other known communication techniques in order to determine the condition of the well at any time, as well as instructing the computer to change or to carry out specified commands.

The controller knows when it is "fresh from the factory" and automatically goes to the calibration mode. This causes the green L.E.D. light G of FIG. 5 to blink on and off, indicating that the pump-off control (POC) is awaiting a calibration button press. The calibration button should be pressed once, at the desired point of fluid pound. After the calibration button has been pressed, the green L.E.D. will stay on, and the controller will average the last strokes to obtain the fluid pound stroke speed average. The controller will then stop the pump, wait the preset downtime, start the unit, wait the present pump-up time, and then obtain three strokes that represent the full pump stroke speed average. Using these two numerical valves, the controller will calculate the time differential to be used for the pump-off control. This time differential is stored in the battery memory and the working memory for future use. It is important that nothing interrupt the "calibration" cycle. If a bad delta factor is calculated, the controller will not accept the calibration, it will blink the red L.E.D. R of FIG. 5 for twenty-five seconds, then re-enter the calibration mode. The calibration mode will blink the green L.E.D. when it is ready to accept another calibration button press. The controller will not allow a bad calibration under any circumstances, but will always keep trying until a good calibration is obtained. The controller is restored to the "factory fresh" state by the following sequence of actions: first, turn off the power to the pump-off control (POC), press and hold both the calibration and reset pushbuttons. While holding both buttons, turn the power back on. After a short period, release both buttons; the green L.E.D. will blink, indicating that the circuitry is in the calibration mode. Normally, the special "factory fresh" operation is only needed when moving the pump-off control (POC) from one well to a new well.

It may be desirable to re-calibrate the pump-off control (POC) after it has been on a well for some time. In this situation, the controller has values stored in the battery memory, and only an update is needed. This is accomplished by pressing the calibrate pushbutton once to enter calibration mode. This will cause the green L.E.D. to blink, and the controller will run the well until the desired magnitude of pump-off is encountered. When this pump-off condition is reached, the calibration pushbutton is pressed again, (a second press). This informs the controller to use the last stroke as the average fluid pound stroke speed. The controller will shut the pump off, wait the preset downtime, start the pump motor, wait the preset pump-up time, then obtain the full pump stroke speed average and calculate the appropriate delta factor. Note that this sequence should not be interrupted. This is the normal method of calibrating the pump-off control (POC).

The reset button will end a downtime, clear a rod part malfunction, or cause the pump-off control (POC) to exit percent timer mode back to pump-off control (POC) mode of operation, if percent timer switch is in pump-off control (POC) mode. It forces the POC to use the factors from the last POC cycle for reference, and forces the POC into "runtime". If a "total reset" is desired, use the power-up method as follows.

Whenever the power comes on, the well shuts down for the preset time. The controller performs a complete system reset, clears working memory, copies factors stored in battery memory over to working memory, performs other "housekeeping" tasks, and then lights the green L.E.D. to indicate the controller is operational. Note that the green L.E.D. is not a power-on light, but rather it is a "POC OK" light. Failure to light the green L.E.D. indicates some type of hardware problem. If the POC is "fresh from the factory", it will force a calibration. If the POC has been calibrated previously, it will force a downtime, allowing the well to stabilize to a known state, i.e. full pump. This power-up downtime may be interrupted by pressing the reset button, with no ill effects upon POC operation.

The percent timer (standby timer) mode is always indicated by the yellow L.E.D. Y. The controller can enter percent timer operation from three configurations; the first is by setting the "mode" toggle switch to the percent timer position. The second is the result of a sensor failure, which occurs whenever the magnetic switch is open or shorted. Repeated entry into percent timer mode usually indicates an intermittent magnetic switch, or that a conductor wire is shorted together or cut. The third is the "short-run violation". This occurs when the run cycle just completed is less than ½ of the switch setting for the on-time of the percent timer. Returning to POC mode is the same for all situations including rod part. Press the reset pushbutton once, unless the mode switch is in percent timer position; in this instance, turn the switch back to the POC mode, then press reset button. POC or percent timer can also be reset by momentarily interrupting the AC power supply on the large motor panel; however, this will cause the POC to do a normal downtime if the control is in the POC mode.

The computer program disclosed in FIGS. 6A through 6I are the preferred means by which the present invention can be carried out.

One skilled in the art, having the present disclosure before him, will be able to program a suitable computer apparatus and achieve all of the above described control expedients.

I claim:

1. In a pumpjack unit having a rod string connected thereto and extending downhole in a borehole and connected to reciprocate a downhole pump apparatus having a pump plunger and a barrel, said rod string being reciprocated by said pumpjack unit which is actuated by a prime mover, the method of shutting-in the well for a selected length of time when the pump apparatus encounters a pumped-off condition of operation, comprising the steps of:

(1) measuring successive time intervals for the pump to downstroke with a full pump barrel;

(2) measuring successive time intervals for the pump to downstroke when the pump apparatus approaches a pump-off condition and the pump barrel is progressively less than full;

(3) measuring the time differential between steps (1) and (2) and using the resultant differential measurement to provide a series of pump-off signals;

(4) selecting one of the series of pump-off signals in step (3) which is of a magnitude that is representative of the occurrence of an undesirable pump-off condition;

(5) using the selected pump-off signal of step (4) to de-energize the prime mover and thereby discontinue the pumping action for a selected time interval.

2. The method of claim 1 wherein the prime mover of the pumpjack unit includes an electric motor connected to a gear box having a crank which rotates and thereby reciprocates the rod string by means of a walking beam; and, steps (1) and (2) are carried out by mounting a magnet and a magnetically responsive transducer onto the pumpjack unit at a location which moves the magnetic field of the magnet into close proximity to the transducer each reciprocation of the rod string to thereby cut the transducer with lines of magnetic flux and actuate the transducer to thereby provide the signals of step (3) which is related to differences in the length of time required for the pump to downstroke;

and carrying out step (5) by interrupting current flow to the electric motor; and, restarting the motor after said selected time interval has expired by restoring current flow to the motor.

3. The method of claim 2 and further including the steps of:

mounting said magnet to said crank so that said magnet describes a circle of 360 degrees each cycle of operation of the pumpjack unit;

mounting said transducer in fixed relationship respective to the gear box and at a location whereby the magnet passes in close proximity to said transducer and thereby actuates the transducer each cycle of operation of the pumpjack unit.

4. The method of claim 2 wherein an alarm means is mounted to structure associated with said pumpjack unit;

energizing said alarm means for a predetermined time interval prior to energizing said motor.

5. The method of claim 1 wherein said prime mover is an electric motor and steps (4) and (5) are carried out by:

mounting a transducer on said pumpjack unit and measuring the time intervals of steps (1) and (2) with said transducer;

connecting circuit means, including a computer, to receive signals from said transducer and to control current flow to the motor; storing said series of pump-off signals in said computer; and interrupting current flow to the electric motor and thereby shutting in the well whenever the stored signals reach the magnitude of step (4); and, starting the pumpjack motor and producing the well after said selected time interval has expired.

6. The method of claim 1 wherein a detector means for sensing H2S is included in proximity of the pumpjack unit which provides an alarm whenever H2S gas escapes from the wellbore.

7. The method of claim 1 wherein steps (1) and (2) are carried out by mounting a transducer means to the pumpjack and actuating the transducer at the same relative position during each reciprocation of the rod string;

(6) measuring the time interval between successive downstrokes of the rod string to provide the measured time interval of step (1);

(7) measuring the time interval between successive downstrokes to provide the measured time interval of step (2);

(8) storing data related to steps (6) and (7);

(9) comparing the measured time intervals of steps (6) and (7) and shutting-in the well when the time difference of steps (6) and (7) reaches a magnitude indicative of fluid pounding.

8. Pump-off controller for a pumpjack unit of the type wherein a prime mover causes a polish rod to upstroke and then downstroke to reciprocate a downhole pump comprising:

means for measuring successive time intervals for the rod to reciprocate the downhole pump;

computer means by which the measured time intervals are compared to provide a signal when the measured time differential during a full barrel pump downstroke and the measured time differential during a less than full barrel pump downstroke indicates the presence of a pump-off condition;

circuit means by which the computer is connected for energizing and de-energizing said prime mover;

means by which said computer means is connected to cause said circuit means to energize said prime mover after a predetermined downtime, and for said prime mover to continue to run until the measured time intervals change to a predetermined value indicative of said pump-off condition, whereupon said signal causes said computer means to de-energize said prime mover for said predetermined downtime.

9. The controller of claim 8 wherein the polish rod is reciprocated by a rotating crank and said signal represents the time differential for the rotating crank of the pumpjack unit to reciprocate the rod for 360 degrees of crank rotation with a full barrel compared to the time interval to reciprocate the rod 360 degrees of crank rotation with less than a full barrel, wherein said less than a full barrel is a time interval which is of shorter duration than the full barrel time interval and therefore is indicative of a pump-off condition.

10. The controller of claim 9 wherein the 360 degrees of crank travel is measured by actuating a signal means each cycle of operation of the pumpjack unit.

11. The controller of claim 9 wherein said pump-off controller includes timer means by which the pumpjack unit is run in the standby mode whenever a time interval longer than the duration of one cycle of operation expires without receiving a signal whereby said pumpjack unit operates intermittently as the timer means energizes the motor for a set length of time and thereafter de-energizes the motor and shuts-in the unit for a set downtime.

12. The controller of claim 8 wherein the pumpjack unit is shut-in by said computer means whenever the measured time intervals of successive downstrokes of the polish rod provides said signal.

13. The controller of claim 8 wherein means are provided by which an alarm is sounded and then the prime mover is started when the controller has completed the downtime.

14. In a pumpjack unit having a motor driven gear box that drives a crank, the crank being connected to rock a walking beam, the walking beam being connected to reciprocate a rod string which extends downhole in a wellbore and is connected to upstroke and downstroke a pump device each 360°rotation of the crank, a motor controller for energizing and de-energizing the motor, the combination with said pumpjack unit of a pump-off control apparatus;

said pump-off control apparatus includes signal producing means mounted respective to said pumpjack unit for producing a signal that is initiated at the same relative position of operation of the rod string each 360°rotation of the crank whereby the time interval between two successive signals is related to the length of time for the rod string to downstroke the pump device during one rotation of the crank;

means for measuring the time interval between successive signals; computer means by which successive time intervals between a plurality of successive signals is measured, said computer means compares a last measured time interval to an average of a plurality of immediately preceding time intervals and when the time differential between said last time interval and said average reach a predetermined magnitude that is indicative of a pump-off condition, the computer means actuates the motor controller which de-energizes the motor whereupon the pumpjack unit ceases operation of the pump device and the well is shut-in.

15. The combination of claim 14 and further including timer means by which the well remains shut-in for a predetermined length of time and then said computer means causes said motor to be restarted by said motor controller;

alarm means connected to be actuated a time interval prior to energization of the pumpjack unit.

16. The combination of claim 14 wherein said signal producing means is a switch means mounted to be actuated each time the crank of the pumpjack unit completes 360 degrees of rotation, and a length of time between successive actuations of the switch provides said measured time interval.

17. The combination of claim 14 wherein said signal producing means is a switch means connected to be actuated each oscillation of the walking beam and said measured time interval is the length of time required between successive actuations of said switch means.

18. The combination of claim 14 wherein the signal producing means includes a switch means that is connected to be actuated each revolution of the gear box crank and said time interval between successive signals includes at least the time during which the pump device is on the downstroke.

19. The combination of claim 14 wherein said signal producing means includes a transducer means connected to produce a signal each reciprocation of the rod string; and the time interval between successive signals is determined by actuating said transducer means during each cycle of operation of the pumpjack unit.

20. The combination of claim 14 wherein a magnet is placed on the crank, and said signal producing means is a magnetically actuated transducer which is positioned in the path of the magnetic flux of the magnet so that the transducer intercepts the magnetic flux of the rotating magnet and is magnetically actuated to thereby provide said produced signal.

* * * * *